US006652051B1

(12) United States Patent
Kokkas

(10) Patent No.: US 6,652,051 B1
(45) Date of Patent: Nov. 25, 2003

(54) SHEET HOLE PUNCHING SYSTEM IN OUTPUT COMPILER OF REPRODUCTION APPARATUS

(75) Inventor: Michael Kokkas, Toronto (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/260,196

(22) Filed: Sep. 27, 2002

(51) Int. Cl.[7] ..... B41J 2/01; G03G 15/00
(52) U.S. Cl. ..... 347/3; 399/407
(58) Field of Search ..... 347/1, 3, 8, 4, 347/44, 14, 23, 104; 395/113, 502, 109; 355/324; 227/27; 270/58.07, 53; 271/184, 113, 250, 245; 399/126, 407, 13, 25, 31, 57, 106

(56) References Cited

U.S. PATENT DOCUMENTS

| | | | | |
|---|---|---|---|---|
| 4,541,626 A | | 9/1985 | Millen | 271/236 |
| 4,575,296 A | | 3/1986 | Kockler et al. | 412/6 |
| 4,763,167 A | | 8/1988 | Watanabe et al. | 355/14 |
| 4,819,021 A | | 4/1989 | Doery | 355/13 |
| 4,826,383 A | | 5/1989 | Millen | 414/789.9 |
| 4,988,030 A | | 1/1991 | Muramatu et al. | 227/27 |
| 5,014,977 A | | 5/1991 | Moore et al. | 271/221 |
| 5,044,625 A | | 9/1991 | Reid | 271/293 |
| 5,120,047 A | | 6/1992 | Mandel et al. | 271/220 |
| 5,201,517 A | | 4/1993 | Stemmle | 271/291 |
| 5,261,655 A | | 11/1993 | Keller et al. | 271/187 |
| 5,289,251 A | | 2/1994 | Mandel et al. | 355/324 |
| 5,342,034 A | | 8/1994 | Mandel et al. | 270/53 |
| 5,409,202 A | | 4/1995 | Naramore et al. | 270/53 |
| 5,508,799 A | | 4/1996 | Irie | 355/324 |
| 5,628,502 A | | 5/1997 | Amarakoon | 270/58.07 |
| 5,970,217 A | * | 10/1999 | Nakamura | 395/113 |

OTHER PUBLICATIONS

IBM Technical Disclosure Bulletin vol. 22, No. 8A, Jan., 1980, pp. 3119–3120.

* cited by examiner

*Primary Examiner*—Raquel Yvette Gordon
*Assistant Examiner*—Charles W. Stewart, Jr.
(74) *Attorney, Agent, or Firm*—Lloyd F. Bean II

(57) ABSTRACT

In a sheet output system with a stacking tray for accumulating, registering, and stacking on top of preceding sheets in a superposed set stack the printed sheets sequentially individually outputted by a reproduction system; a low force sheet hole punching system integral the output stacking tray for punching holes through only one individual sheet at a time on top of the set stack, before the next sequential sheet is so registered and stacked, with all of the sheets having underlying commonly superposed sheet holes.

4 Claims, 3 Drawing Sheets

SHEET HOLE PUNCHING SYSTEM IN OUTPUT COMPILER OF REPRODUCTION APPARATUS

Figure 1:
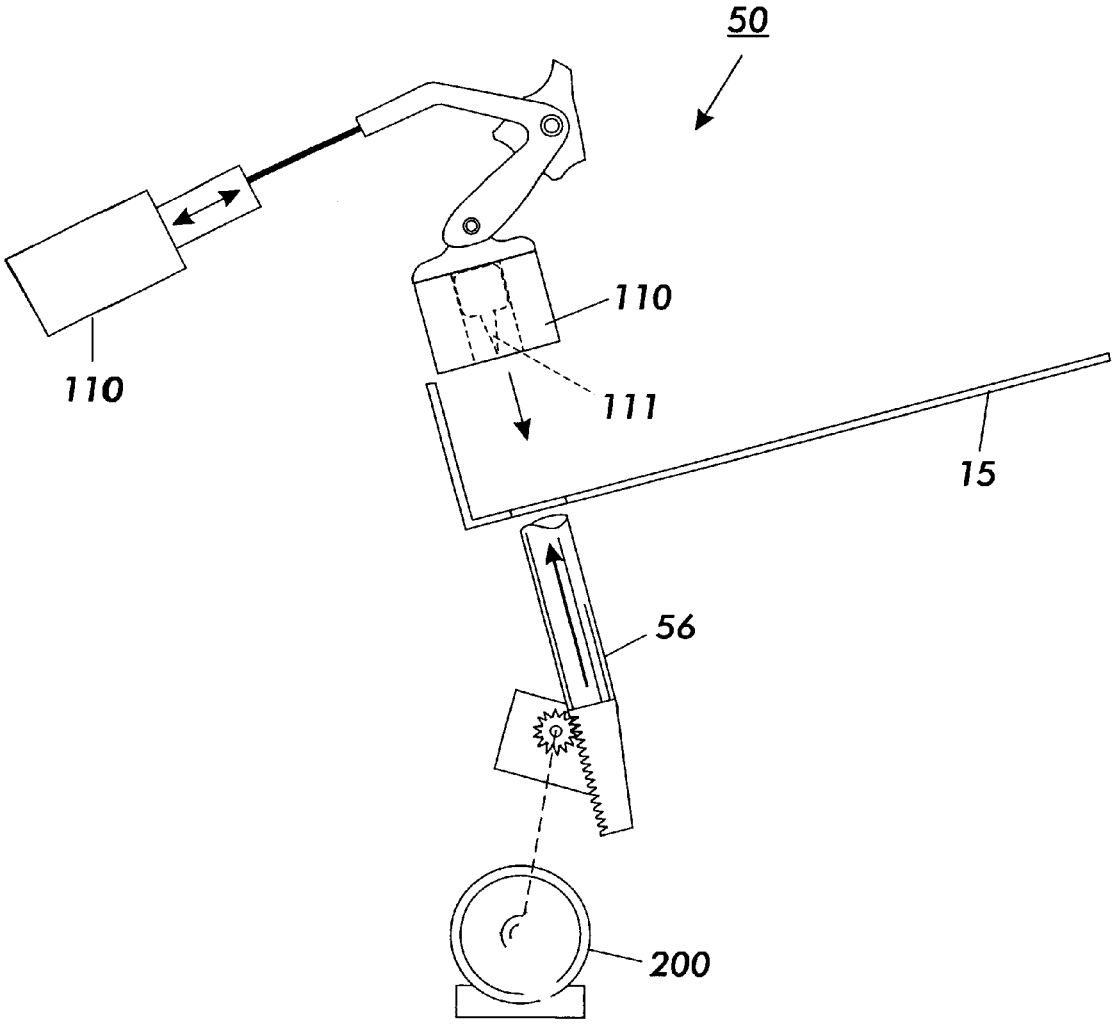

The disclosed embodiment relates to an improved system of on-line selectable hole punching of printed sheets of paper or the like as they are being outputted by a copier or printer, which is simple, low cost, and compact, and can be integrated entirely within an existing compiler/stacker sheet output system for said reproduction apparatus. In this disclosed system, each sheet is individually hole punched, one sheet at a time, as each sheet is outputted and commonly stacked, using the preceding punch holes in the underlying sheets of the stack as a punch dye, thus allowing a much lower punching force for the hole punching as compared to hole punching through an entire set of sheets at once.

Users of copiers, printers, or other reproduction apparatus frequently desire their print jobs to be outputted as sets of printed sheets already prepunched, so that the job sets can be directly or even automatically put into three ring, two ring, or other standard notebooks or binders. Such binders typically require sheets with holes of an appropriate number and spacing from the edge margin of the sheet and from one another.

Commonly, this is now provided by loading prepunched paper stock into the copier or printer and then printing on those prepunched sheets. This has, however, several disadvantages. First, it required pre-ordering, purchasing, stocking and warehousing of such special prepunched paper, so that it is available when such print jobs are needed. Several different weights, sizes, and/or colors of such special use prepunched paper may be required to be stored on hand, with associated inventory and other costs. Secondly, prepunched holes in the sheets can interfere with proper feeding or printing of such sheets; for example, by falsely actuating or triggering lead or trail edge sheet sensors in the sheet feeding path of the printer or copier. Thirdly, since the first or odd page of the print job must have the prepunched holes on the left margin of the sheet, not the right margin, and so forth for subsequent pages, the orientation in which such prepunched sheets are loaded into the copier or printer is critical for proper orientation of the printed image relative to the holes. Such prepunched stock is, of course, not even available for roll or web fed copiers or printers as opposed to pre-cut sheet fed copiers or printers. Nor is it suitable for letterhead or other pre-printed paper stock.

To overcome the above and other disadvantages of prepunched (also referred to as predrilled) paper stock, some copiers have begun to offer on-line hole punching of the sheets during or immediately after the printing process in the copier, so that conventional unpunched blank copy sheet stock may be utilized, yet provide appropriately punched print jobs in the output. Also, it has been suggested in prior patents. Noted, for example, is Xerox Corporation U.S. Pat. No. 4,819,021 issued Apr. 4, 1989 is to Michael S. Doery, noting particularly the left-hand sides of FIGS. 3 and 4 and Col. 8 (Attorney Docket No. D/86170). IBM Technical Disclosure Bulletin Vol. 22, No. 8A, January 1980, pages 3119–3120, discloses a multiple pattern rotary punch of a type previously used for punching rolls of web-like material, for use in in-line copier or offset press oscillatory punching of single copy sheets. The punch device disclosed can be fitted with different arrays of hole patterns. Mead Corporation U.S. Pat. No. 4,575,296 issued Mar. 11, 1986 to Kockler, et al, especially the bottom of Col. 3, and reference No. 40, also suggests on-line hole punching. Also, Canon U.S. Pat. No. 4,763,167 issued Aug. 9, 1988 to T. Watanabe, et al; and Mita U.S. Pat. No. 5,508,799 issued Apr. 16, 1996 to Irie. On-line hole punching of the copier output is believed to have been available in a Konica "7090 RF" product since approximately 1988. Noted is Konica U.S. Pat. No. 4,988,030 issued Jan. 29, 1991 to Muramatu et al. Further, Xerox Corporation U.S. Pat. No. 5,628,502 issued May 13, 1997 to Kiri Amarakoon, discloses a sheet output system with a stacking tray for accumulating, registering, and stacking on top of preceding sheets in a superposed set stack the printed sheets sequentially individually outputted by a reproduction system; a low force sheet hole punching system integral the output stacking tray for punching holes through only one individual sheet at a time on top of the set stack, before the next sequential sheet is so registered and stacked, with all of the sheets having underlying commonly superposed sheet holes which function as a punch die.

These references also note that on-line hole punching can be provided with or without stapling or other set binding in addition thereto, a feature for which the disclosed embodiments are also compatible.

The disclosed system is usable with a wide variety of sheet output compilers and stackers. Some examples include Xerox Corp. U.S. Pat. Nos. 4,541,626; 4,826,383; 5,044,625; 5,201,517; 5,120,047; 5,014,977; 5,289,251; 5,342,034; 5,261,655; and 5,409,202; and other references cited therein. As will be further described herein, the disclosed embodiment integrally incorporates an on-line hole punching system into a compiler/stacker in a manner which is fully compatible with and may cooperatively utilize the sheet entrainment and movement provided by the compiler/stacker, and other elements thereof. This integrated system enables optional on-line hole punching to be provided in the output sheets without any increase in the overall size of the sheet output system, or any reduction in printing speed. Also, the sheet punching as disclosed herein is desirably at the exposed output end of the printing system, and therefore is readily accessible for adjustments, repairs, and, most importantly, jam clearances of any sheet jams or removal of sheets during machine stoppages. That is, the hole punching system disclosed herein is not buried internally within the copier or printer in an access-restricted location.

Another advantage of the disclosed integral hole punching and stacking embodiment is that the hole punching is accomplished on-line yet without having to interrupt, even briefly, the sheets printing. Yet, the sheet edge is registered and deskewed before and during hole punching here, which is essential for proper positioning of the punched holes in the sheets and for consistent hole positions in the outputted set. Not only is the edge of the sheet being punched here registered, the existing transverse registration system of the existing compiler/stacker, of, for example, said above-cited patents, may desirably be utilized to provide transverse registration of the sheet prior to its hole punching as well. That is, both of the existing process direction and lateral registration systems provided by the output stacker can provide a dual mode function, in that they can also provide both forward and lateral registration of the sheet for punching of the desired pattern of holes therein in the proper positions therein. Thus, preexisting registration and stacking systems can be used with only minor, low cost, additions or modifications.

As noted, a particular advantage of the disclosed system is that the hole punching force is greatly reduced. Here, only one sheet at a time is punched, rather than a whole set of sheets.

A specific feature of the specific embodiments disclosed herein is to provide, in a sheet output registering and stacking system with an output stacking tray for accumulating, registering, and stacking on top of preceding sheets in a superposed set stack the printed sheets sequentially individually outputted by a reproduction system, the improvement comprising a low force on-line sheet hole punching system integral said output stacking tray for punching holes through only one said individual sheet at a time on top of said superposed set stack of printed sheets as each said individual sheet is so registered and stacked, and before the next sequential sheet is so registered and stacked, so that all of the preceding sheets of said set stack have underlying commonly superposed holes.

Further specific features disclosed herein, individually or in combination, include those wherein said low force sheet hole punching system has a hole punch normally overlying said superposed set stack of printed sheets in said stacking tray and reciprocally drivable through said individual sheet on top of said superposed set stack of printed sheets and at least partially through said underlying commonly superposed holes of said underlying sheets of said set stack, which superposed holes of said underlying sheets function as a punch die; and wherein said hole punch has a reciprocal punch driving system automatically actuated as each said individual sheet is so registered and stacked, and before the next sequential sheet is so registered and stacked; and/or wherein there is additionally provided a mating punch die provided by an aperture in said stacking tray underlying said superposed set stack of printed sheets and said hole punch for functioning as a punch die for the initial sheets of said set stack; and/or wherein a punch waste paper container is mounted under said aperture in stacking tray; and/or wherein a sheet set clamp is mounted with said hole punch to be driven down with said hole punch by said reciprocal punch driving system until said set clamp forcibly engages said individual sheet against said superposed set stack of printed sheets.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software and computer arts. Alternatively, the disclosed control system or method may be implemented partially or fully in hardware, using standard logic circuits or single chip VLSI designs. Conventional sheet path sensors or switches connected to the controller may be utilized for sensing, counting, and timing the positions of sheets in the sheet paths, and thereby also controlling the operation of sheet feeders and inverters, as well as the hole punch driver, etc., as is well known in the art.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Figure 2:
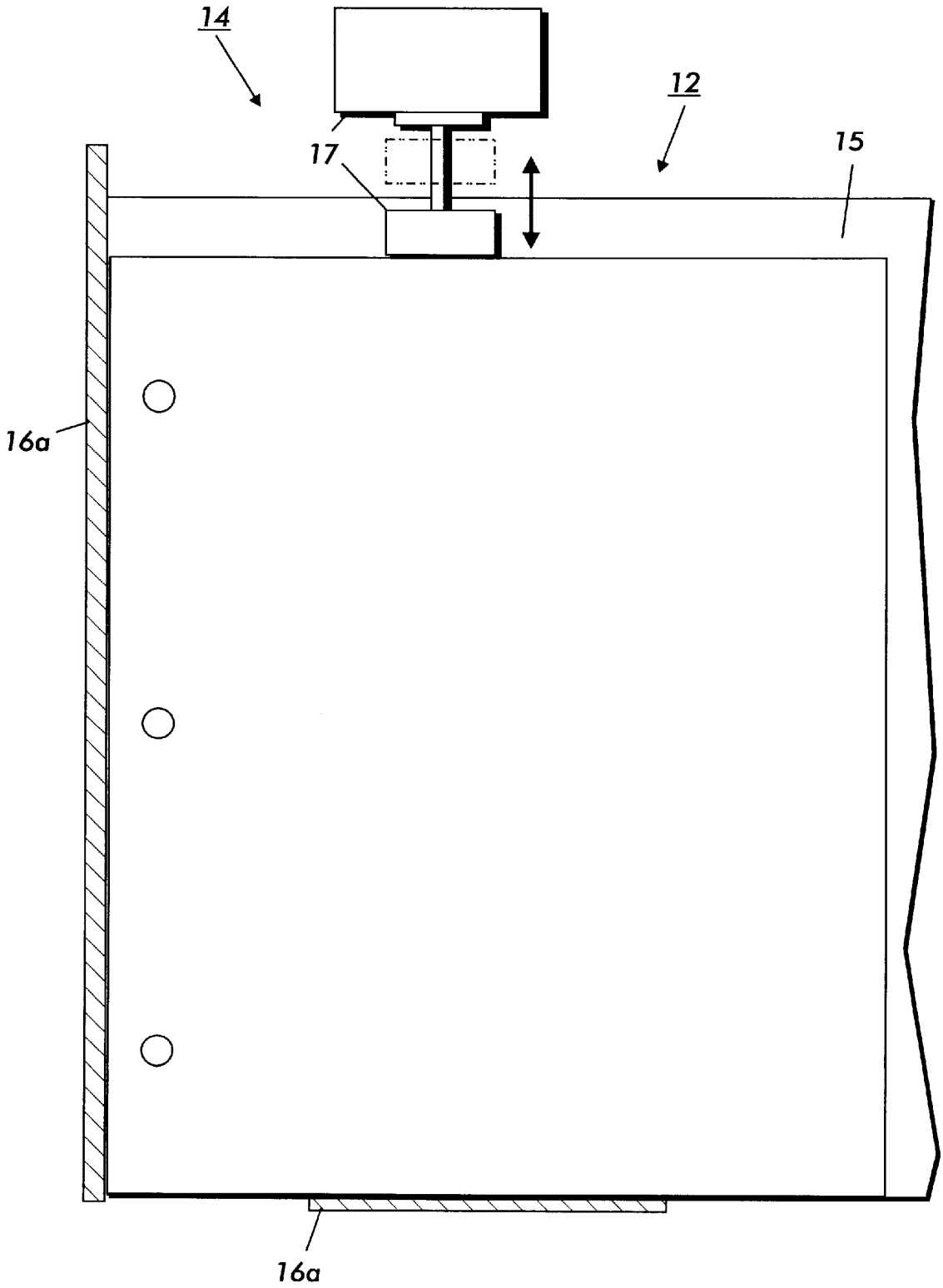
Figure 3:
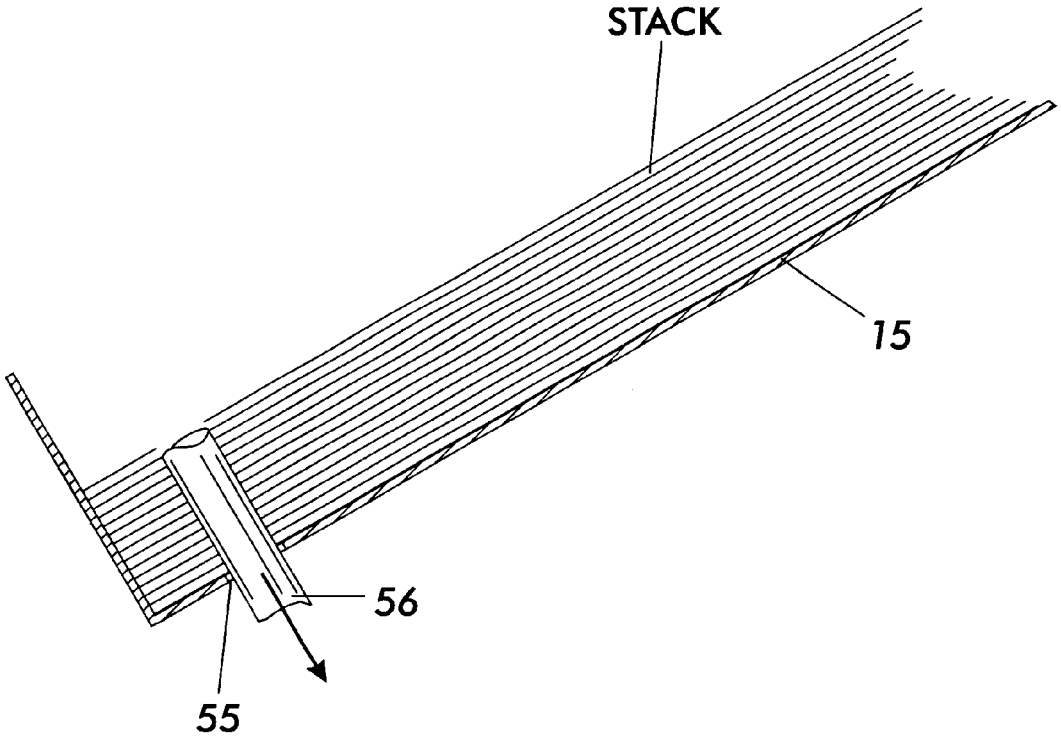

Various of the above-mentioned and further features and advantages will be apparent from the specific apparatus and its operation described in the examples below, and the claims. Thus, the present invention will be better understood from this description of a specific embodiment, including the drawing figures (approximately to scale) wherein:

FIGS. 1 and 3 are schematic side views of one example of an integral sheet hole punching and registered sheet stacker output system for the output of a sheet printing system, shown partially in cross-section; and FIG. 2 is a partial top view of the embodiment of FIG. 1, cut away to show an exemplary three hole punched sheet set in the output tray.

Referring to the example shown in the figures, there is illustrated schematically the output end of an otherwise conventional printing system 10, sequentially feeding its printed sheet output into a connecting finisher module directly associated therewith for on line finishing, exemplified here by a sheet output system 12, including a sheet compiler registration and stacking system 14 having an integral hole punching system 50.

The registration and stacking system 14 in this example, including a stacking tray 15, and registration walls 16*a*, 16*b*, and tamper 17, may be similar to that described in more detail in various of the above-cited U.S. patents, and accordingly said conventional, pre-existing, features need not be described in detail herein except as to the important modifications thereof for the hole punching system 50 to be subsequently described. As in conventional output systems, the outputted printed sheets are fed by exit roller nips into the registration/stacker system 14, until the sheet lead edge and one lateral edge engage respectively the orthogonal registration walls 16*a* and 16*b*, which provide deskewing and sheet edge registration of the incoming sheet, assisted by tamper 17, or other known sheet jogger or top flapper systems. At least one lateral edge of the sheet is engaged by the lateral sheet tamping system 17, which tamps or slides the sheet laterally into wall 16*b*. Thus, the incoming sheet is both forwardly and laterally registered in tray 15, assisted by gravity by the downward slope of tacking tray 15. It will be appreciated that this is merely one example and that other stacker operations and registration systems are well known.

Turning now to the exemplary hole punching system 50 illustrated in this example, it may be seen that it is fully integrated into the existing registration stacker sheet output system 14. Preferably, three sheet punch assemblies are provided, so as to provide for simultaneous standard two or three hole punching. The punching of the punches can be overlapping or sequential, and punching can be applied by a cam and motor as shown much more gradually than with a solenoid punch, for lower impact and quieter operation. With the punching system disclosed herein, the punching can even be accomplished by a conventional clutch takeoff from an existing sheet drive of the system illustrated by its existing drive motor M.

Although only one hole punch is visible in FIG. 1 of the embodiment, it will be appreciated that, as is conventionally practiced, two or three spaced punches may be provided along the edge of the sheet at the proper margin positions for simultaneously or overlappingly punching two or three punch holes in the sheet. This, of course, reduces the required punching time as compared to moving a single hole punch to a different position along the edge of the sheet for sequentially punching the punch holes in the sheet. The use of plural substantially simultaneously actuated hole punches also allows the present system to be advantageously utilized to provide punched sheet output without requiring any delays or skipped printing cycles in the copier or printer outputting the sheets to be so processed.

It will also be appreciated that all of the punches may be preferably conventionally mounted for lateral position adjustment such as being mounted on slide rails or rods so that the proper position and spacing of the punch hole locations can be reset to the type of binder utilizing the holes, the size of the sheets being punched, the registration position of the sheets being outputted relative to the punches, etc.

The sheet punch assemblies 52 has sheet set acquisition slots for acquiring a lead edge margin of the sheet therein for punching. A cylindrical punch 56 of the standard hole punch diameter is movable upward from the lower side of the punching area 55 toward and through the tray 15 bottom. Each hole punch 56 is hollow and has a conventional tapered sharp edge front face to punch a round hole in the sheet while the sheet is in the appropriate position. Die 100 coacts with punch 56 to produce the round hole in the sheet. Punch moves upward to meet die 100; die 100 is moved down by solenoid assembly 110 to clamp the to the stack to punch a hole in the sheet. As the stack height of the sheets increases the starting point of punch is raised by motor 200. This keeps the punch time low and also this feature assist with stack set registration as the punch acts as a locating pin for the stack. Pin 111 is mounted inside die 100 to ensure that the "chad" produce by the punch is transferred through the hollow punch to be collected in collection bin (not shown).

Each sheet punch assembly 52 is preferably mounted independently for lateral repositioning here, such as being laterally slidable along a mounting shaft, to suit the particular customer desired hole punching positions. For two hole punching, two of the punch assemblies may be moved into the desired hole positions thereof, and the third or outboard punch assembly may be moved laterally completely out of the sheet path for that size sheet, so as to be inoperative. Set screws or other detents may be utilized to hold the punch assemblies in their selected lateral positions. They are not subjected to any significant lateral forces. Alternatively, or additionally, the camming system may be removed or disengaged for one or all of the punch assemblies when hole punching is not desired. It will be appreciated that many other alternatives can be provided, especially for the punch actuating system 60.

The hole punches here are not actuated until after the binding edge of the sheet has been fully registered in the output tray preferably with scuffing and/or tamping devices, as described above. This can be conventionally determined simply by a preset time delay after the trail edge of the sheet leaves the sheet path sensor in the output of the copier or printer, or a sheet path sensor in input nip feed rollers of the finishing device or module, which is ejecting the sheet into the stacking tray 15. Note that the stacking tray 15 may desirably be inclined downhill as shown towards the lead edge registration edge to assist in obtaining and maintaining registration with that lead edge registration wall 16*a*.

Once the sheet punching has been accomplished, the respective punches 56 may be conventionally retracted back to their initial positions for receiving a subsequent sheet. After an entire set has been hole punched, it may be conventionally automatically removed or ejected. Optionally, stapling, stitching or binding can be additionally provided before or after such set removal.

While the embodiments disclosed herein are preferred, it will be appreciated from this teaching that various alternatives, modifications, variations or improvements therein may be made by those skilled in the art, which are intended to be encompassed by the following claims.

What is claimed is:

1. In a sheet output registering and stacking system with an output stacking tray for accumulating, registering, and stacking on top of preceding sheets in a superposed set stack the printed sheets sequentially individually outputted by a reproduction system, comprising:

a low force on-line sheet hole punching system integral said output stacking tray for punching holes through only one said individual sheet at a time on top of said superposed set stack of printed sheets as each said individual sheet is so registered and stacked, and before the next sequential sheet is so registered and stacked, so that all of the preceding sheets of said set stack have underlying commonly superposed holes, said low force sheet hole punching system includes a die normally overlying said superposed set stack of printed sheets in said stacking tray and a hole punch underlying sheets of said stack, said punch hole is raised in through each sheet in said sheets of said stack as said die drives toward said punch hole thereby driving through said individual sheet on top of said superposed set stack of printed sheets.

2. The sheet output registering and stacking system of claim 1, wherein said low force sheet hole punching system has a punch driving system automatically actuated as each said individual sheet is so registered and stacked, and before the next sequential sheet is so registered and stacked.

3. A printing maching having a sheet output registering and stacking system with an output stacking tray for accumulating, registering, and stacking on top of preceding sheets in a superposed set stack the printed sheets sequentially individually outputted by a reproduction system, comprising:

a low force on-line sheet hole punching system integral said output stacking tray for punching holes through only one said individual sheet at a time on top of said superposed set stack of printed sheets as each said individual sheet is so registered and stacked, and before the next sequential sheet is so registered and stacked, so that all of the preceding sheets of said set stack have underlying commonly superposed holes, said low force sheet hole punching system includes a die normally overlying said superposed set stack of printed sheets in said stacking tray and a hole punch underlying sheets of said stack, said punch hole is raised in through each sheet in said sheets of said stack as said die drives toward said punch hole thereby driving through said individual sheet on top of said superposed set stack of printed sheets.

4. The sheet output registering and stacking system of claim 3, wherein said low force sheet hole punching system has a punch driving system automatically actuated as each said individual sheet is so registered and stacked, and before the next sequential sheet is so registered and stacked.

* * * * *